US012313377B1

(12) United States Patent
Steadman

(10) Patent No.: US 12,313,377 B1
(45) Date of Patent: May 27, 2025

(54) RIFLE SCOPE MOUNT

(71) Applicant: Bart David Steadman, Little Rock, AR (US)

(72) Inventor: Bart David Steadman, Little Rock, AR (US)

( * ) Notice: Subject to any disclaimer, the term of this patent is extended or adjusted under 35 U.S.C. 154(b) by 0 days.

(21) Appl. No.: 18/584,573

(22) Filed: Feb. 22, 2024

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 11/004
See application file for complete search history.

(56) References Cited

U.S. PATENT DOCUMENTS 1,022,249 A * 4/1912 Matheson ..... F41G 11/004 356/247
1,263,667 A * 4/1918 Henderson et al. ..... F41G 1/35 362/114
1,702,101 A * 2/1929 Basterreix ..... F41G 1/35 362/208
1,865,127 A * 6/1932 McKeen ..... F41G 11/004 362/396
2,193,094 A * 3/1940 Gilbert ..... F41G 11/004 24/19
2,447,892 A * 8/1948 Baliff ..... F41G 11/004 362/396
2,601,613 A * 6/1952 Jahncke ..... F41G 1/34 248/295.11
2,769,895 A * 11/1956 Boord ..... F41G 11/004 248/229.24
3,222,511 A * 12/1965 Breeding ..... F21V 33/00 362/802
3,833,799 A * 9/1974 Audet ..... F41G 1/345 362/800
4,000,403 A * 12/1976 Rice ..... F41G 1/35 362/370
4,542,447 A * 9/1985 Quakenbush ..... F21V 21/08 362/183
4,697,226 A * 9/1987 Verdin ..... F41G 1/35 362/110
6,598,331 B1 * 7/2003 Thibodeaux ..... F41G 1/52 42/111
7,614,805 B2 * 11/2009 Showalter ..... G03B 17/566 396/428
7,882,654 B1 * 2/2011 Marcum ..... F41C 27/00 42/146
8,714,072 B1 * 5/2014 Villarreal ..... F41G 3/165 42/130
8,739,452 B1 * 6/2014 Calvert ..... F41G 11/004 42/106

(Continued)

*Primary Examiner* — Michelle Clement
(74) *Attorney, Agent, or Firm* — Cynthia S. Lamon; Lamon Patent Services

(57) ABSTRACT

A mounting assembly enabled to adhere a sighting scope to a rifle is provided including a mounting rail attached to an upper edge platform of a rail mount and an extension bar attached at a lower edge of the rail mount at one end. A first ring clamp and a second ring clamp spaced apart and attached at a second end of the extension bar is provided, distal to the one end, and the first and second ring clamps are enabled to be secured to the rifle via tightening bolts enabling secure positioning of a sighting scope on the rifle without permanently modifying or scaring the rifle.

14 Claims, 4 Drawing Sheets

(56) References Cited

U.S. PATENT DOCUMENTS

| | | | | |
|---|---|---|---|---|
| 9,690,090 | B2 * | 6/2017 | Russ | F41G 1/345 |
| 11,441,872 | B2 * | 9/2022 | Balgaard | F41G 1/22 |
| 2006/0026888 | A1 * | 2/2006 | Cheng | F41G 11/004 42/146 |
| 2018/0364009 | A1 * | 12/2018 | Hancosky | F41G 11/003 |
| 2020/0248986 | A1 * | 8/2020 | Hancosky | F41G 11/003 |

* cited by examiner

RIFLE SCOPE MOUNT

BACKGROUND OF THE INVENTION

1. Field of the Invention

The present invention is in the field of firearm accessories and pertains particularly to methods and apparatus for mounting a sighting scope to a rifle. In one embodiment, the scope is mounted to an M1 Garand rifle.

2. Description of Related Art

The M1 Garand rifle is a vintage semi-automatic that served as the US Army's service rifle during World War II replacing the bolt action Springfield rifle, the M1.

M1 Garand is chambered for a 0.30-0.06 Springfield Cartridge and has an effective range of about 500 yards in the field. A civilian version of the M1 Garand may be purchased for recreational use. An M1 Garand rifle includes iron sighting components typical to the M1 and later models include a rear annular sight protected by metal ears that line up with a front sight post. As known in the prior art, M1 Garand rifles were not manufactured in a manner enabling practical mounting of a scope, and scopes were not used with an M1 Garand.

A rifle scope is composed of multiple parts including the lenses, reticle, turrets, and eyepiece, each playing a crucial role in sighting and aiming at a target. In recreational ownership of the M1 Garand or similar rifle, owners desired to include a scope on such rifles for longer range sighting. Current scope mounting kits and procedures are available but require some alteration of the M1 rifle profile for successful mounting and alignment.

Therefore, what is clearly needed is a sight scope mounting assembly and method enabled to removably mount to a rifle including at least an M1 Garand type rifle without requiring any modifications to the rifle, itself, to accommodate hardware of the mounting assembly.

BRIEF SUMMARY OF THE INVENTION

A novel sighting scope mounting assembly for a rifle is provided, comprising a mounting rail attached to an upper edge platform of a rail mount, an extension bar attached at a lower edge of the rail mount at one end, and a first ring clamp and a second ring clamp spaced apart and attached at a second end of the extension bar, distal to the one end. In this embodiment, the first and second ring clamps are enabled to be secured to the rifle via tightening bolts enabling secure positioning of a sighting scope on the rifle without permanently modifying or scaring the rifle.

The rifle may be any rifle the first and second ring clamps may attach to without obstructing function of the rifle. In one embodiment the rifle is any one of an M1 Garand or M1 Carbine rifle. Additionally, an inside surface of the first and second ring clamps have a material adhered to prevent denting and scratching of the rifle. In this embodiment, the material is any one of rubber, plastic, or a composite thereof to prevent direct contact between the inside surface of the ring clamps and the rifle.

In a preferred embodiment, the rifle has an iron sight attached along a longitudinal bore axis of the rifle and the mounting assembly holds the sighting scope to a left side of the longitudinal bore axis, from a perspective of a user sighting a target with the rifle, thereby enabling a user to sight a target with either the sighting scope or the iron sight.

In one embodiment, the mounting rail is a picatinny rail. The first and second ring clamps may be made from a flexible band such that when assembled and tightened around the rifle the first and second ring clamps conform to a shape of the rifle.

A method of attaching a sighting scope to a rifle is provided comprising the steps of attaching a mounting rail to an upper edge platform of a rail mount, attaching an extension bar at a lower edge of the rail mount at one end of the extension bar, and attaching a first ring clamp and a second ring clamp, spaced apart, to a second end of the extension bar, distal to the one end. In this embodiment, the first and second ring clamps may be fastened around a stock and barrel of the rifle thereby positioning the sighting scope on the rifle without permanently modifying or scaring the stock or barrel of the rifle.

In one embodiment of the method, the rifle may be anyone of a M1 Garand or M1 Carbine rifle. An inside surface of the first and second ring clamps may have a material adhered to prevent denting and scratching of the rifle. In this embodiment, the material is any one of rubber, plastic, or a composite thereof to prevent direct contact between the inside surface of the ring clamps and the rifle.

In another embodiment, the rifle has an iron sight attached along a longitudinal bore axis of the rifle and the mounting assembly holds the sighting scope to a left side of the longitudinal bore axis, from a perspective of a user sighting a target with the rifle, thereby enabling a user to sight a target with either the sighting scope or the iron sight.

Additionally, the mounting rail may be a picatinny rail. In another embodiment, the first and second ring clamps are made from a flexible band such that when assembled and tightened around the rifle the first and second ring clamps conform to a shape of the rifle.

DETAILED DESCRIPTION OF THE INVENTION

In various embodiments described in enabling detail herein, the inventor provides a unique apparatus and method for mounting a scope to a rifle. In this embodiment the mounting apparatus is mounted to an M1 Garand rifle. The present invention is described using the following examples, which may describe more than one relevant embodiment falling within the scope of the invention.

Figure 1:
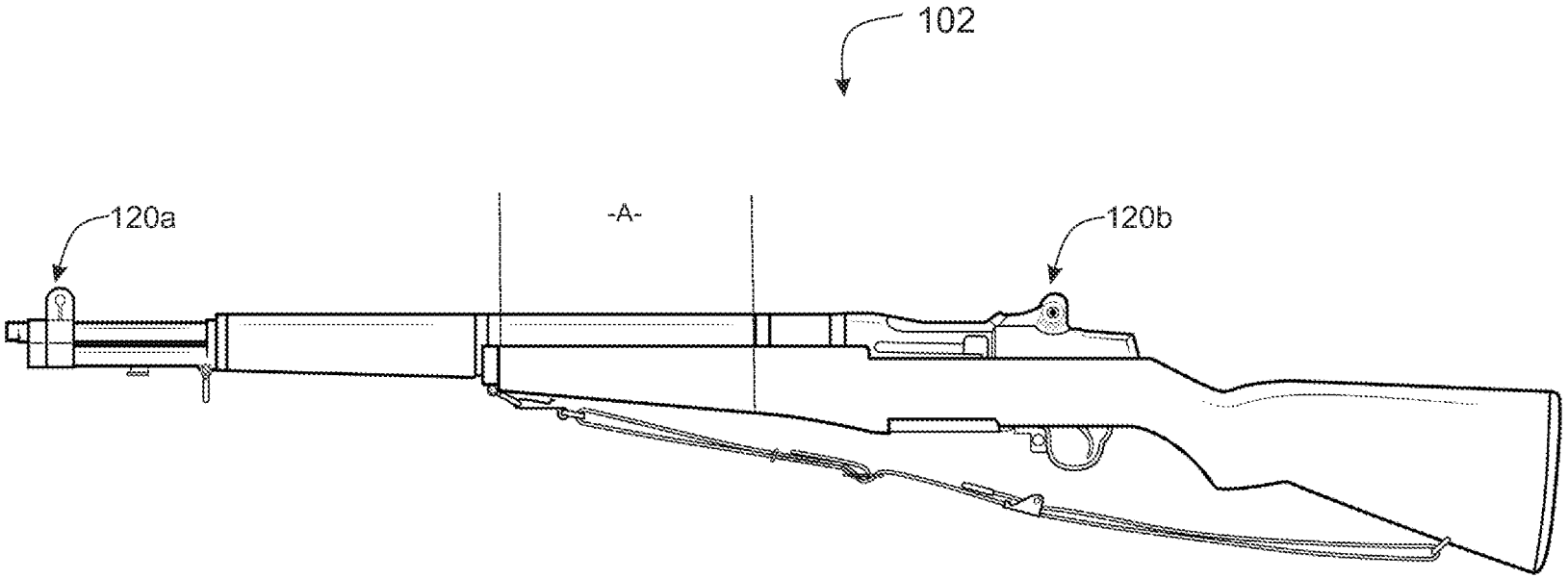
FIG. 1 is an illustration of an M1 Garand rifle with an area demarcated for accepting a scope mounting assembly.

FIG. 1 depicts a rifle 102 of the prior art marked with two vertical dotted lines forming demarcation A of a portion of the rifle for removably attaching a mounting apparatus attached to a sight scope. Although the mounting apparatus may be mounted on a plurality of rifles of different makes and models, the rifle of FIG. 1 is specifically an M1 Garand or M1 Carbine type rifle. A front aperture iron sight 120*a* and a rear aperture iron sight 120*b* are centered along a longitudinal axis, or bore axis, at a top surface of the rifle and align together enabling a user to sight a target.

Figure 2:
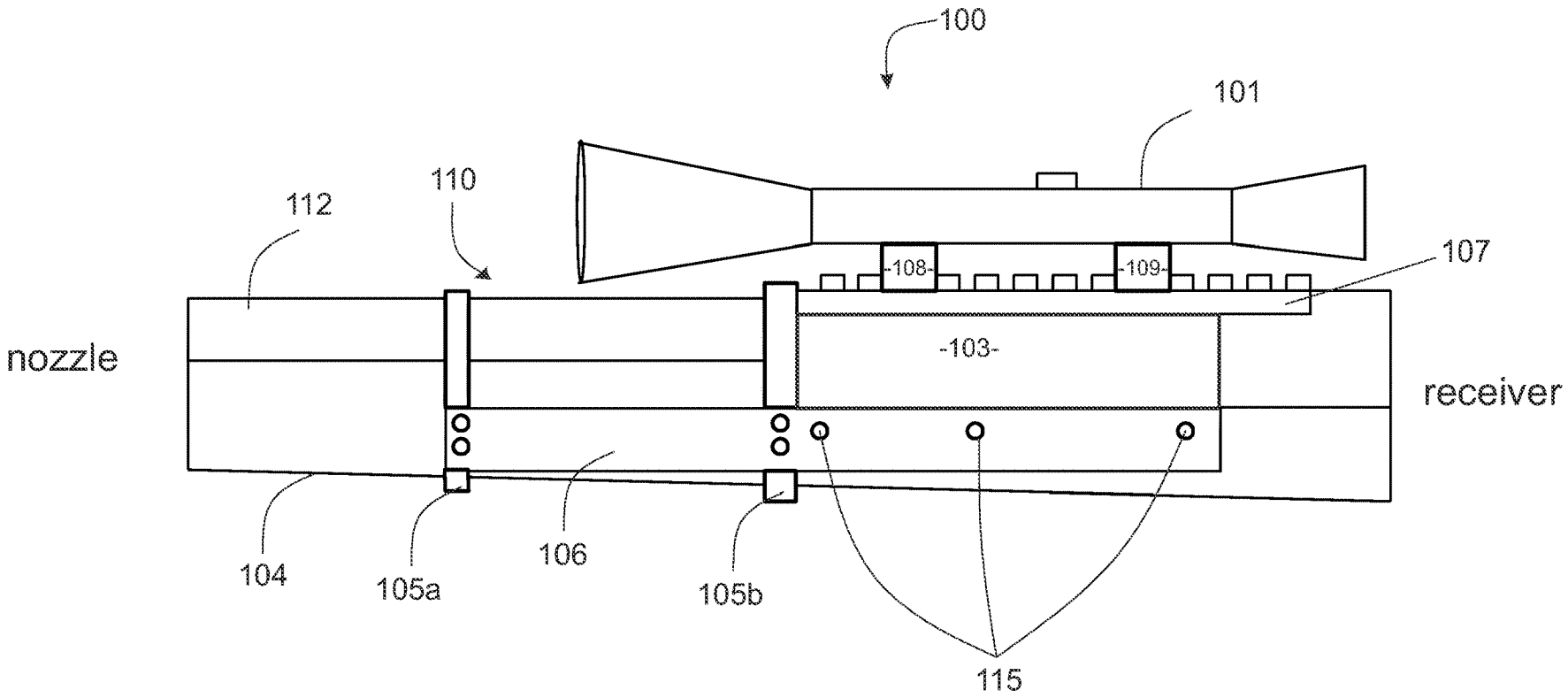
FIG. 2 is an elevated view of the mounting hardware assembly and sight scope in a mounting position on the M1 Garand rifle shown in FIG. 1.

FIG. 2 depicts the rifle 102 of FIG. 1 with a sighting scope 101 mounted to the rifle via a scope mounting assembly 110 positioned within portion A. The terms nozzle (front) and receiver (rear or stock) depict the orientation of the rifle 102. Mounting hardware assembly 110 includes a first ring clamp 105*a* and a second ring clamp 105*b*. Ring clamps 105*a* and 105*b* may be fabricated from flat steel bars that may be form-bent to fit snugly around the combined girth of stock 104 and barrel 112 of the rifle 102. Ring clamps 105*a* and 105*b* are held substantially parallel to one another and are spaced apart and attached, via welding, tap screw or other means on an outside surface of the ring clamps to a flat steel extension bar 106. Extension bar 106 extends towards the receiver end of the rifle, or rearward some distance. In one embodiment, the lengths of the flat steel strips used to make the first and second ring clamps are shorter than the average stock girth of rifle 102 for the purpose of enabling a gap in the rings that may be bridged by a nut and bolt tightening clamp (not shown).

Extension bar 106 may be drilled toward the receiver end of the rifle in order to attach to a lower planar platform 103*a* (see FIG. 3) attached to the mounting rail 107. Attachment hardware may be self-tapping screws or welding, for example. Scope mounting rail 107 may be fabricated of a steel plate having a horizontal flat bottom for attaching to platform 103*a*, which is mounted to extension plate 106. A top edge of the mounting rail 107 comprises equidistantly spaced protuberances, similar to a picatinny rail known in the art for enabling mounting of scope 101 at a proper alignment for sighting of a target. In a preferred embodiment, the mounting assembly is positioned so bar 106, and rail mount 103 are positioned on a left side of the rifle 102 from a user's point of view sighting a target. In this embodiment, the mounting rail 107 and scope 101 are mounted on a left side of the rifle so a sight scope mounted via the assembly would be positioned just left of the longitudinal or bore axis of the rifle. In this position the front and rear aperture iron sights 120*a* and 120*b* (see FIG. 1) may be implemented by a user to sight a target, or the sighting scope may be implemented to sight targets that may be further away from the user.

In this embodiment, extension bar 106 includes three rail mount openings 115 provided there through that are aligned with three openings (not shown) on scope mounting rail 107. Openings 115 may be tapped for machine cap screws, but any sufficient attachment means may be used. In one embodiment, scope mounting hardware apparatus 100 may be fabricated of a material aside from steel such as ABS plastic or another material having high rigidity and high thermal resistance.

Figure 3:
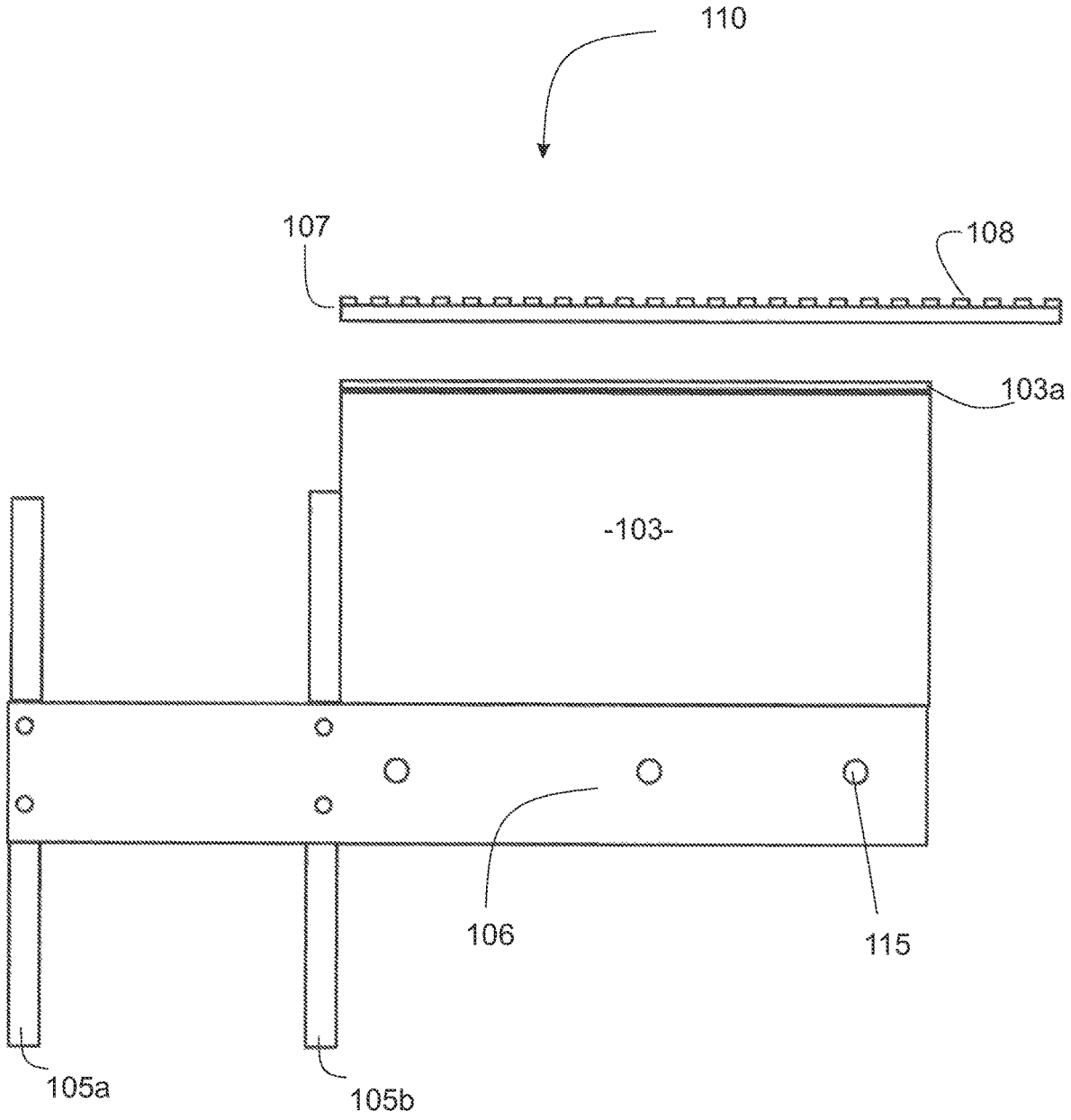
FIG. 3 is an exploded view of the mounting hardware assembly.
Figure 4:
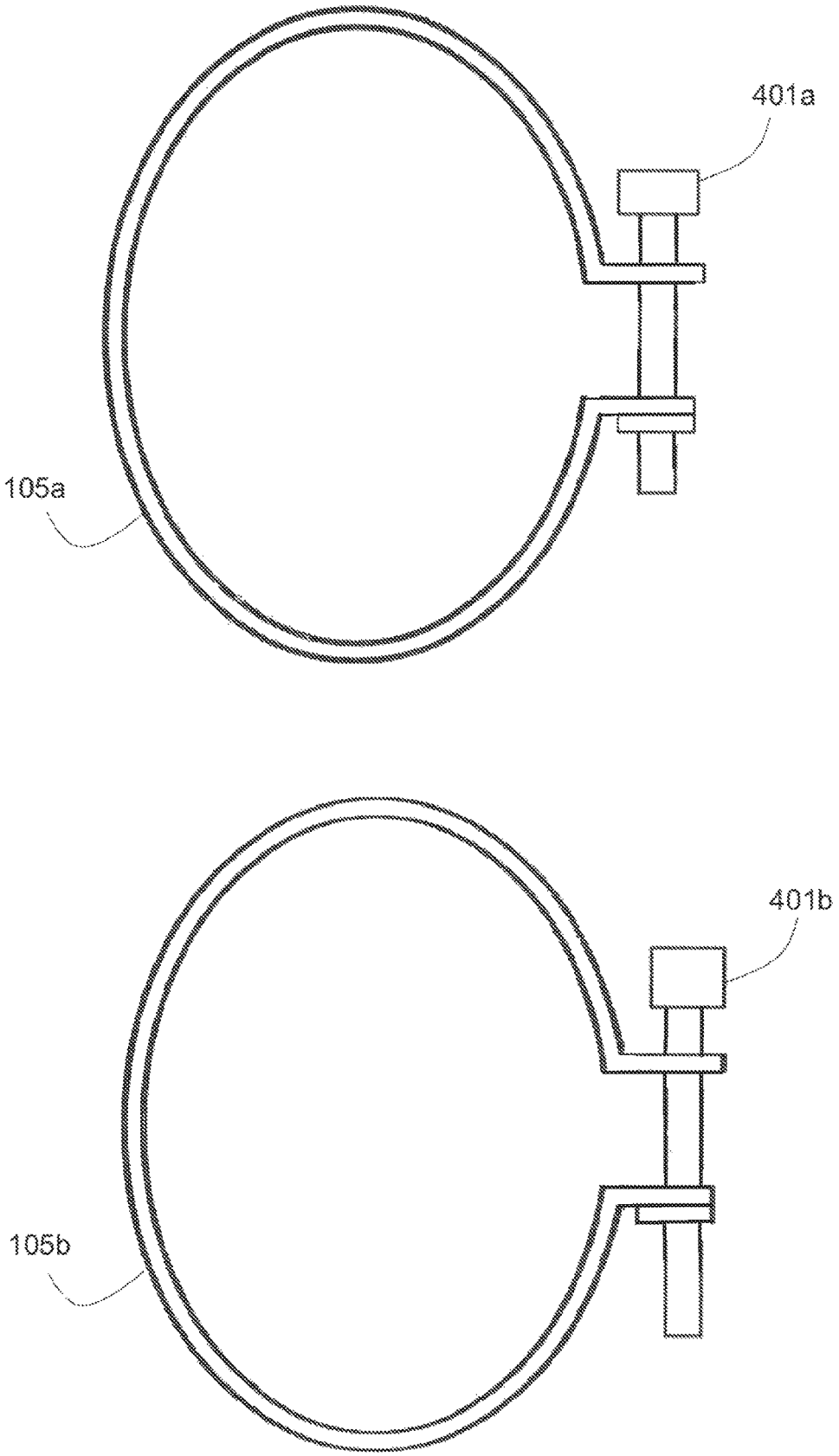
FIG. 4 is an elevated side view of the ring clamps of the mounting hardware assembly.

Referring to FIG. 3, mounting hardware assembly 110 is depicted in an unmounted view for the purpose of clarity. Extension bar 106 supports first and second clamp rings 105*a* and 105*b* by weld, tap screw or other attachment means. Clamp rings 105*a* and 105*b* each have both ends bent orthogonally outward forming clamp ears that may be drilled through to support a bolt and nut hardware 401*a* and 401*b* as shown in FIG. 4. In one embodiment, a jig may be provided to hold first and second ring clamps 105*a* and 105*b* into correct position and to hold extension bar 106 at the correct position for welding or other means of attachment.

In one embodiment, extension bar 106 may have a finished length of about seven inches, a width dimension of approximately three quarters of an inch, and a material thickness of about one-eight of an inch. In this embodiment rail mount openings 115 placed through extension bar 106 are five-sixteenth of an inch in diameter. Clamp rings 105*a* and 105*b* are spaced apart one and three-quarter inches from inside edge to inside edge on extension bar 106. The outside-to-outside edge spacing may be about two and three-quarter inches accounting for bar width.

Referring to FIG. 3, in a preferred embodiment, openings on rail mount 103 (not shown) are threaded openings for accepting one-quarter-20 cap screws three-eighths of an inch long inserted through the extension bar and into the tapped holes on the rail mount 103. In this embodiment, the mounting edge 103*a* of rail mount 103 is approximately three inches in length and rises to two inches in height. The scope mounting rail 107 is approximately six inches in overall length. Mounting protuberances 108 forming grooves occupy the top edge of mounting rail 107 and are equidistantly spaced along a top edge.

Referring to FIG. 4, ring clamps 105*a* and 105*b* are depicted. Hardware 401*a* and 401*b* are visible connected through the formed ear portion of each ring clamp. In this embodiment, hardware 401*a* and 401*b* includes a hex head machine screw and nut. In this embodiment, a thread nut welded to the outside surface of the clamp ear opposite the ear supporting the screw head engages the threaded shaft and enables tightening or loosening clamps 105*a* and 105*b*.

In a preferred embodiment, the inside surfaces of first and second clap rings 105*a* and 105*b* are coated with a buffer material such as rubber or plastic or a composite thereof to prevent steel contact with the surface of the rifle stock 104. In one embodiment, a rubber strip having a length equal to an inner surface circumference of the flat steel ring bar forming clamps 105*a* and 105*b*, may be glued to the inner surface of the clamp ring.

Once installed, the ring clamp installed nearest the nozzle may be slightly larger inside to inside surface than the other ring clamp 105*a* or 105*b*. Ring clamps dimensions ranges from about two and seven-eighths inches and a horizontal middle inside diameter of about two and one-eight inches to two and three-quarter inches and a horizontal middle diameter of about two inches. In this view, hardware 401*a* and 401*b* may be in the form of an eight-thirty seconds by one inch hex-head machine screw and a matching nut tack welded onto an underside surface of an opposing mounting ear of clamp 105*a* and 105*b* from the head of the screw.

It will be apparent with skill in the art that the scope mounting hardware assembly of the present invention may be provided using some or all the elements described herein. The arrangement of elements, size, and functionality thereof relative to the scope mounting apparatus of the invention is described in different embodiments, each of which is an implementation of the present invention. While the uses and methods are described in enabling detail herein, it is to be noted that many alterations could be made in the details of the construction and the arrangement of the elements without departing from the spirit and scope of this invention.

The invention claimed is:

1. A sighting scope mounting assembly for a rifle, comprising;

a mounting rail attached to an upper edge platform of a rail mount;

an extension bar attached at a lower edge of the rail mount at one end; and a first ring clamp and a second ring clamp spaced apart and attached at a second end of the extension bar, distal to the one end, and wherein the first and second ring clamps are enabled to be secured to the rifle via tightening bolts enabling secure positioning of a sighting scope on the rifle without permanently modifying or scaring the rifle.

2. The mounting assembly of claim 1, wherein the rifle is anyone of a M1 Garand or M1 Carbine rifle.

3. The mounting assembly of claim 1, wherein an inside surface of the first and second ring clamps have a material adhered to prevent denting and scratching of the rifle.

4. The Mounting assembly of claim 3, wherein the material is any one of rubber, plastic, or a composite thereof to prevent direct contact between the inside surface of the ring clamps and the rifle.

5. The mounting assembly of claim 1, wherein the rifle has an iron sight attached along a longitudinal bore axis of the rifle and the mounting assembly holds the sighting scope to a left side of the longitudinal bore axis, from a perspective of a user sighting a target with the rifle, thereby enabling a user to sight a target with either the sighting scope or the iron sight.

6. The mounting assembly of claim 1, wherein the mounting rail is a picatinny rail.

7. The mounting assembly of claim 1, wherein the first and second ring clamps are made from a flexible band such that when assembled and tightened around the rifle the first and second ring clamps conform to a shape of the rifle.

8. A method of attaching a sighting scope to a rifle comprising the steps of:

attaching a mounting rail to an upper edge platform of a rail mount;

attaching an extension bar at a lower edge of the rail mount at one end of the extension bar; and attaching a first ring clamp and a second ring clamp, spaced apart, to a second end of the extension bar, distal to the one end, and placing the first and second ring clamps around a stock and barrel of the rifle thereby positioning the sighting scope on the rifle without permanently modifying or scaring the rifle.

9. The method of claim 8, wherein the rifle is anyone of a M1 Garand or M1 Carbine rifle.

10. The method of claim 8, wherein an inside surface of the first and second ring clamps have a material adhered to prevent denting and scratching of the rifle.

11. The method of claim 10, wherein the material is any one of rubber and plastic or a composite thereof to prevent direct contact between the inside surface of the ring clamps and the rifle.

12. The method of claim 8, wherein the rifle has an iron sight attached along a longitudinal bore axis of the rifle and the mounting assembly holds the sighting scope to a left side of the longitudinal bore axis, from a perspective of a user sighting a target with the rifle, thereby enabling a user to sight a target with either the sighting scope or the iron sight.

13. The method of claim 8, wherein the mounting rail is a picatinny rail.

14. The method of claim 8, wherein the first and second ring clamps are made from a flexible band such that when assembled and tightened around the rifle the first and second ring clamps conform to a shape of the rifle.

* * * * *